United States Patent [19]

Knieschek

[11] Patent Number: 4,733,599

[45] Date of Patent: Mar. 29, 1988

[54] APPARATUS FOR CONTROLLING THE FLOW OF A PRESSURE FLUID IN A MOTOR

[75] Inventor: Siegbert Knieschek, Köflach, Austria

[73] Assignee: Ing. Waldhauser Maschinenfabrik GmbH & Co. KG, Maria Lankowitz, Austria

[21] Appl. No.: 5,330

[22] Filed: Jan. 15, 1987

Related U.S. Application Data

[63] Continuation of Ser. No. 636,909, Aug. 2, 1984, abandoned.

[30] Foreign Application Priority Data

Aug. 2, 1983 [AT] Austria ..... 2792/83

[51] Int. Cl.[4] ..... F01L 31/00

[52] U.S. Cl. ..... 91/250; 74/100 R; 91/338; 91/346; 91/350; 91/358 R

[58] Field of Search ..... 91/250, 251, 277, 331, 91/337, 338, 344, 346, 350, 358 R, 465; 74/97, 100 R

[56] References Cited

U.S. PATENT DOCUMENTS

| | | | |
|---|---|---|---|
| 1,910,019 | 5/1933 | Kelly | 91/346 |
| 2,887,094 | 5/1959 | Krukemeier | 91/337 |
| 2,997,040 | 3/1961 | Dulebohn et al. | 91/346 |
| 3,007,453 | 11/1961 | Evans | 91/277 |
| 3,175,513 | 3/1965 | Dulaney | 91/277 |
| 4,534,168 | 8/1985 | Brantly | 91/337 |

*Primary Examiner*—Abraham Hershkovitz
*Attorney, Agent, or Firm*—Karl F. Ross; Herbert Dubno

[57] ABSTRACT

An apparatus for controlling the flow of a pressure fluid in a motor includes an arm which cooperates with a locking device to regulate the flow of the pressure fluid through a shut-off member or valve. The arm is connected to a lever which is pivotable about the same axis as the arm. Through resilient means, the arm and the lever are prestressed so that upon movement of the lever into a predetermined position, the arm which is locked in its end positions by a respective lock pawl is released and impelled from one end position into the other. During the movement of the arm, the shut-off valve is actuated so as to regulate the pressure fluid.

4 Claims, 5 Drawing Figures

40
42
44
41
31
7
43
19
45
20

APPARATUS FOR CONTROLLING THE FLOW OF A PRESSURE FLUID IN A MOTOR

This is a continuation of co-pending application Ser. No. 636,909 filed on Aug. 2, 1984, now abandoned.

FIELD OF THE INVENTION

My present invention relates to an apparatus for controlling the flow of a pressure fluid in a motor.

BACKGROUND OF THE INVENTION

In general, the motor is provided with a space of variable dimension and is associated with shut-off members which control the inlet and outlet of the pressure fluid.

Known controlling devices have the disadvantage of a very complicated structure so that they are prone to failures.

OBJECT OF THE INVENTION

It is thus the object of my invention to provide an improved apparatus for controlling the flow of a pressure fluid in a motor obviating the aforestated drawbacks.

SUMMARY OF THE INVENTION

I realize this object, in accordance with the present invention, by providing a lever which is associated with the movable part of the motor and a control arm pivotable between two positions and cooperating with shut-off means or valve means which regulate the inlet and outlet of the pressure fluid. At each end position, the arm is locked by respective lock pawls which are disengageable therefrom by the lever when the latter is to be moved into the predetermined position. The movement of the thus released arm is transmitted via actuators to the valve members for controlling the latter.

The movement of the control arm between its end positions is obtained by resilient means which connect the arm and the lever so that upon disengaging of the respective lock pawl, the arm is impelled by the resilient means from one position into the other.

The apparatus according to my invention provides a very simple structure which ensures rapid and exact control of the valve means. Since the arm is impelled into its end positions, a loss of pressure fluid is prevented which would otherwise occur when e.g. the outlet is opened while the inlet is not yet closed. With respect to motors formed by a bellows, the use of my invention will avoid an overload which might occur when the inlet is opened for a too long period. An exact control of the valve means is especially of importance when motors are concerned which perform only a slow movement e.g. 0.5 to 5 strokes per minute. Such motors are prone to irregularities and it frequently occurs that the valves are controlled or reversed before the motor i.e. the stroke reaches its end position. My present invention avoids these problems especially because the control arm is sufficiently prestressed by the spring and the lock pawls to provide an exact controlling.

According to a further feature of my invention, the resilient means includes two bars sliding within each other to provide a telescopic arrangement and a spring surrounding and loading the bars against the arm and the lever. This arrangement provides a simple and reliable transmission of the spring force onto the arm.

In order to obtain an optimum operation of the apparatus even when using contaminated pressure fluids, it is preferred to use flaps or compressable tubes like for example rollers as shut-off members. Preferably, the movable part of the motor is adjustably associated with the lever via a pivot arm and a shift rod whose one end is hinged to the pivot arm and its other end is connected to the lever to obtain a very robust and insensitive construction. Moreover, such a connection of the movable part with the pivot arm has the advantage that the force exerted by the motor and to be transmitted to the actuators can be suited to any requested need.

BRIEF DESCRIPTION OF THE DRAWING

The above and other features of my present invention will now be described in detail with reference to the accompanying drawing in which.

SPECIFIC DESCRIPTION

Figure 1:
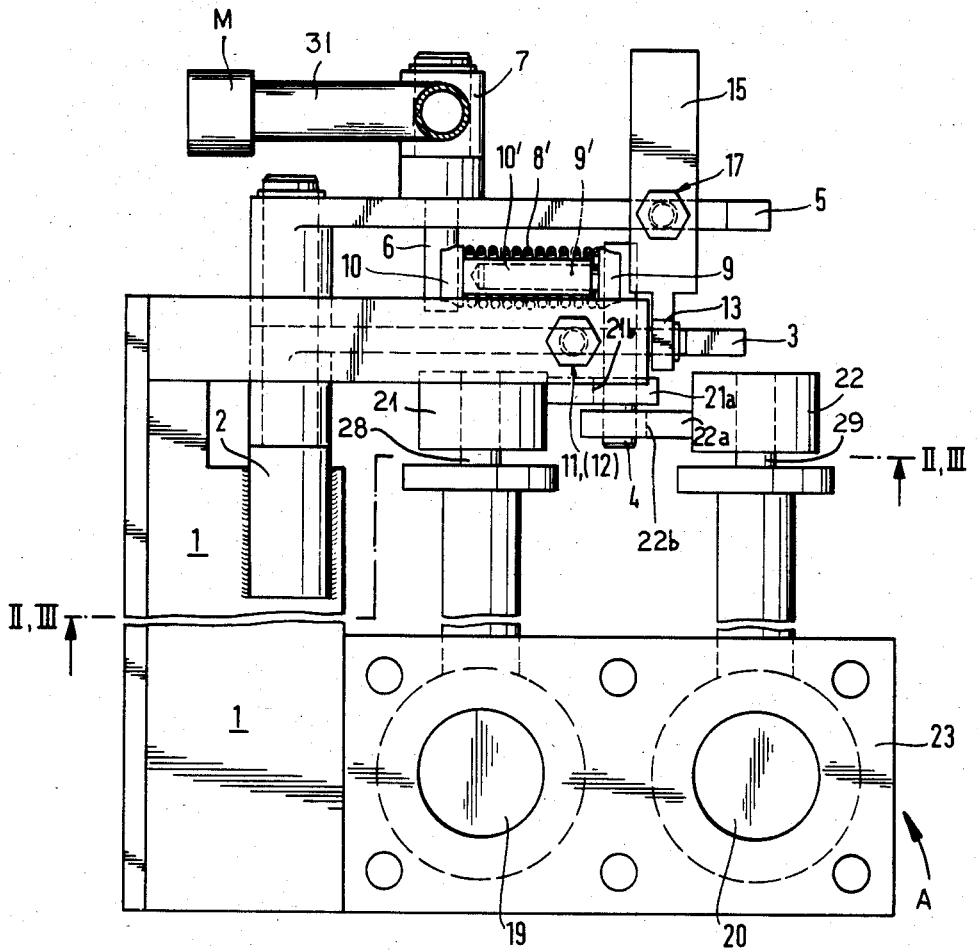
FIG. 1 is a top view of the apparatus according to the invention illustrating a first embodiment of the shut-off members.
Figure 5:
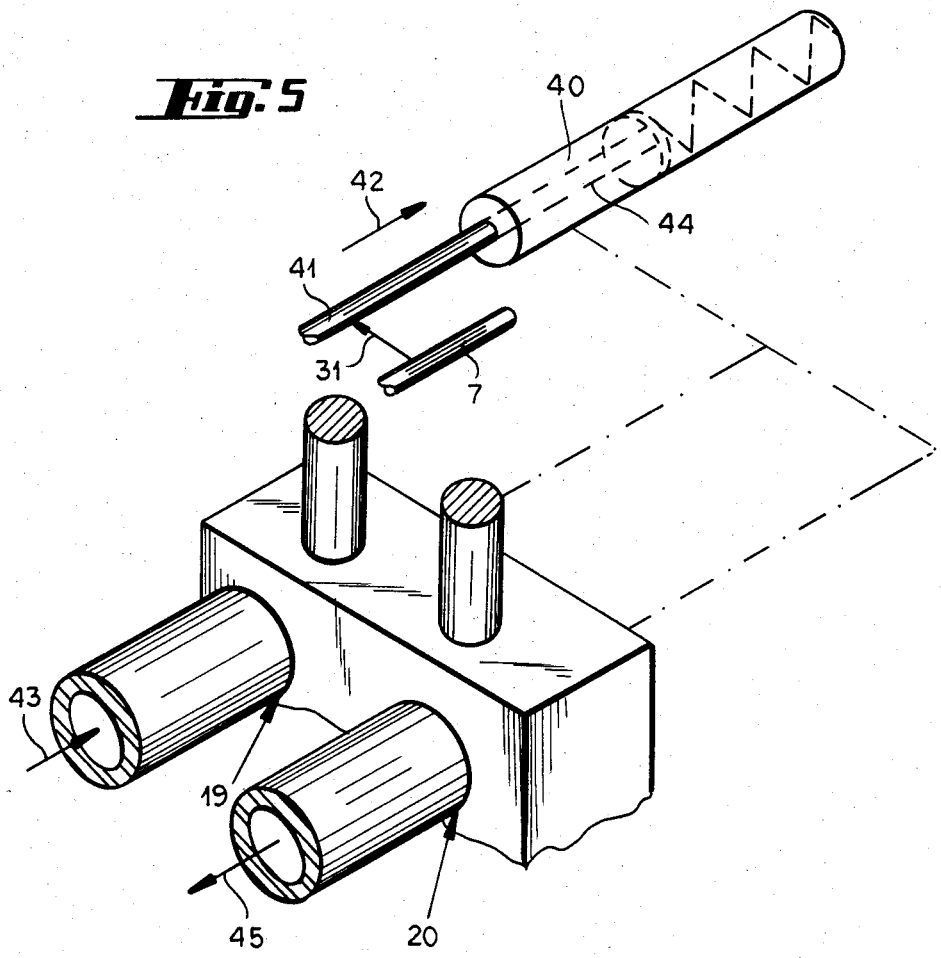
FIG. 5 is a diagram showing an application of FIG. 1.

Referring first to FIG. 1, I have shown a control valve A which includes two flaps 19, 20 controlling the inlet and outlet for a pressure fluid of a motor 40 (FIG. 5). The flaps 19, 20 arranged in a flap chassis 23 are in communication with respective actuators 21, 22 via shafts 28, 29. In order to control the flaps 19, 20 by means of the actuators 21, 22, the latter cooperate with a lever assembly which will now be described in detail.

Each actuator 21, 22 is provided with a respective projecting bar 21*a*, 22*a* the bars being arranged parallel to each other. The projecting bars 21*a*, 22*a* each have a through-opening 21*b*, 22*b* both of which are traversed by a rod 4 extending transversely to the bars 21*a*, 22*a*. The rod 4 is further fixed to a control or rocker arm 3 whose one end pivots about an axle 2 fixed to a frame 1. The rocker arm 3 is movable between two positions which are adjustable by respectively positioned stop elements or blocks 11, 12. The stop blocks 11, 12 are arranged at opposite sides of the frame 1 and are constituted by threaded bolts which can be adjusted from the outside to define the end positions of the rocker arm 3.

Cooperating with the rocker arm 3 is a cantilever arm 5 whose one extremity is hinged to the axle 2 so as to allow a pivoting of the cantilever arm 5 therearound. At a predetermined location, the cantilever arm 5 has a pin 6 which a shift rod 7 acts upon. The shift rod 7 is associated with the motor 40 via its movable part 41 and a swivel arm 31 to which the shift rod 7 is hinged so that depending on movement of the swivel arm the shift rod is shifted upwardly or downwardly. Preferably, the swivel arm is connected to the movable part 41 of the motor in an adjustable manner.

In order to transmit the reciprocating movement of the shift rod 7 to the rocker arm 3, resilient means are provided between the cantilever arm 5 and the rocker arm 3. The resilient means include a spring cap 9 connected to the rod 4 and a further spring cap 10 associated with the pin 6. Located between the spring caps 9, 10 is a spring 8 which surrounds a telescopic rod having two bars 9', 10' sliding within each other. The telescopic bar 9' is joined via rod 4 to the rocker arm 3 while the other bar 10' is hinged to the cantilever arm 5 via the pin 6.

The lever 5 forms with the assembly 9, 10 a toggle linkage establishing stable positions to either side of a dead center position in which the resilient means lies along the axis of arm 3.

The rocker arm 3 is further cooperating with a locking-pawl assembly to maintain the rocker arm 3 in the predetermined positions between the stop blocks 11, 12. The assembly includes two locking pawls 13, 14 which extend parallel to each other and are pivotally fixed to the frame 1. Each locking pawl 13, 14 is shaped as an arrow so as to provide a shoulder 30 against which a detent arm portion of the rocker arm 3 abuts. As I have shown in FIG. 4, the pawls 13, 14 are arranged with their pointed ends facing each other. Through return weights 15, 16, the lock pawls 13, 14 are stressed into the respective engagement position with the rocker arm 3 so that the latter is securely maintained in the predetermined position until the lock pawls 13, 14 are forced out of engagement by means of the cantilever arm 5 as will now be described.

At the extremities, each lock pawl 13, 14 is provided with an adjustable lug 17, 18 which is formed by a thread bolt. Thus, the rocker arm 3 is kept in the locking positions by the pawls 13, 14 as long as the cantilever 5 is not caused to be moved by the shift rod 7 against the respective lug to disengage the pawls 13 or 14 from the rocker arm 3. It is certainly within the scope of the invention to provide these lugs on the cantilever 5 in order to obtain disengagement of the lock pawls 13, 14.

Figure 2:
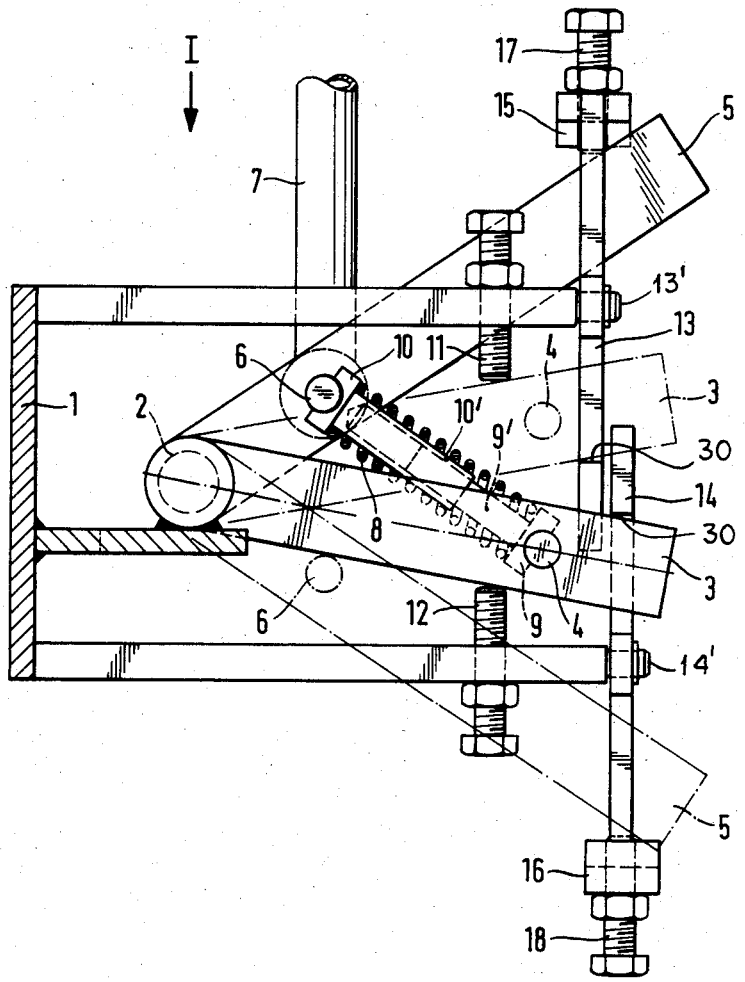
FIG. 2 is a front view of the apparatus according to FIG. 1 illustrating the positions of lever means of the apparatus.
Figure 3:
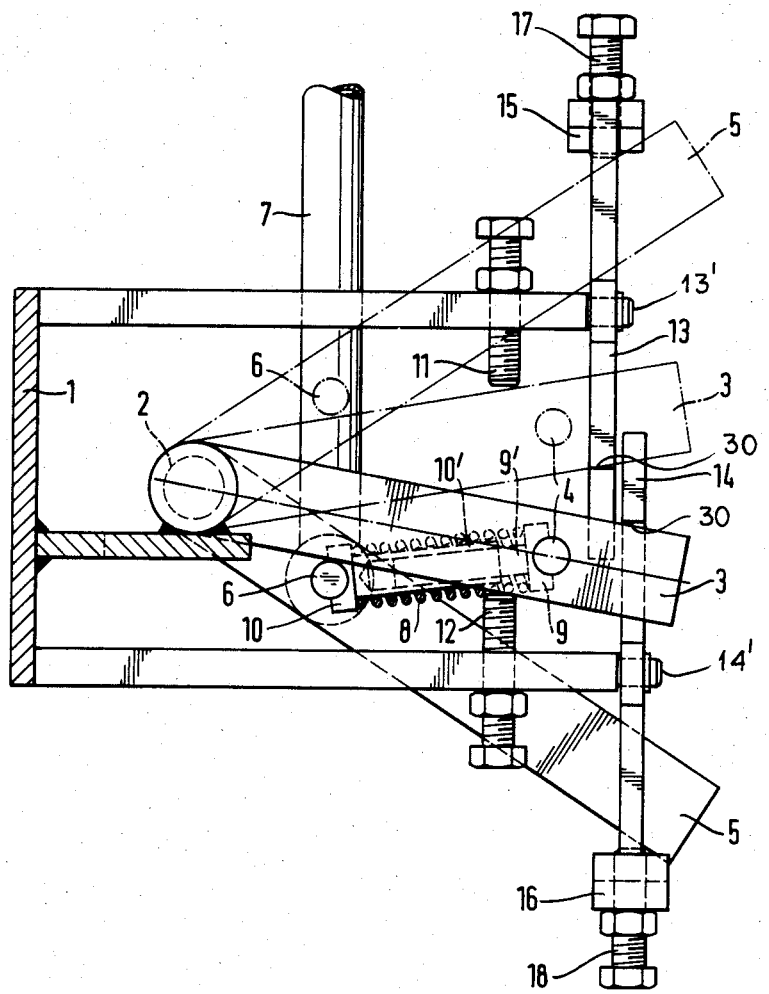
FIG. 3 is a front view similar to FIG. 2.

As a comparison of FIGS. 1, 2 and 3 will show, the pawls 13 and 14 are swingable about respective pivots 13' and 14'.

Figure 4:
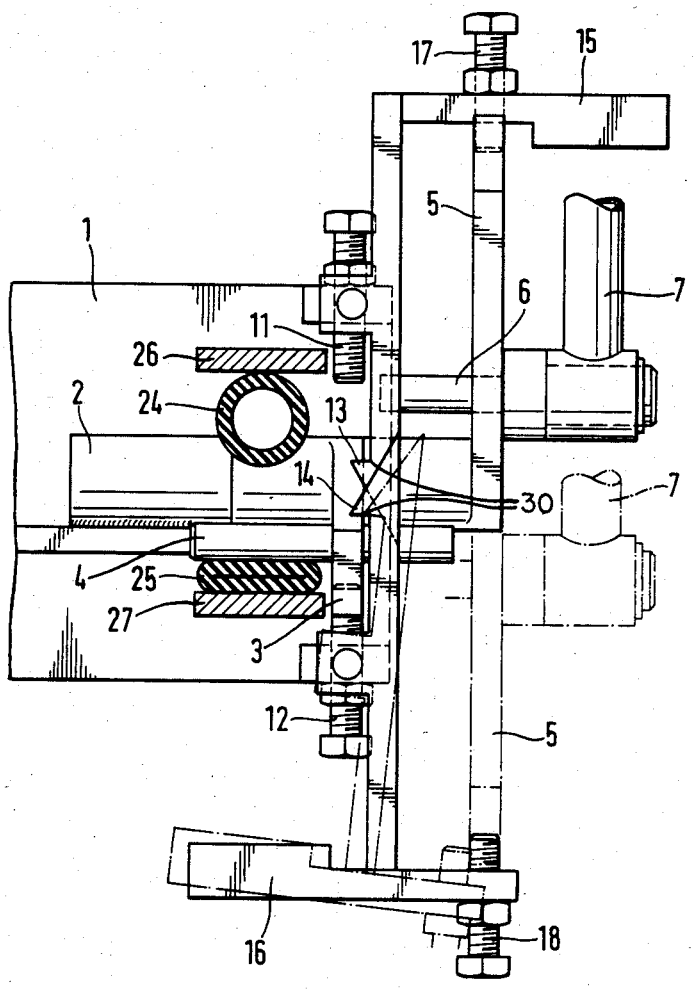
FIG. 4 is a side elevational view of the apparatus according to FIG. 1 illustrating a second embodiment of the shut-off members.

Since the rocker arm 5 engages the abutment 17 or 18 at a location offset from pivot 13' or 14', the thus-engaged abutment will swing the respective detent from an engaged position as shown in solid lines in FIG. 4 to, for example, the dot-dash line position shown, thereby releasing the detent arm 3, the latter springing into its other extreme position under the effect of the compressed spring 8.

As is also apparent from FIG. 1, the shaft 4 which forms a pivot for the telescoping rod 9', 10' can engage one of the arms 21, 22 to rotate one of the shafts 28, 29 and thereby turn the damper disk 19 or 20 which forms the flow control member of the valve 23.

In FIG. 4 I have shown a different embodiment of the valve or shut-off member for controlling the inlet and outlet of the pressure fluid. Instead of the flaps 19, 20 tubes 24, 25 are provided. The tubes are compressible when the rocker arm 3 is moved between its predetermined end positions. When the rocker arm 3 occupies its lower position, the tube 25 is squeezed by the rod 4 against a counter element 27 so that a passage of fluid is prevented while the tube 24 is open for allowing passage of fluid therethrough. When the tube 24 is to be closed, the rocker arm 3 is moved to its other position so as to squeeze the tube 24 by means of the rod 4 against a further counter member 26.

After having described the individual parts of my invention, I will now explain in detail the mode of operation.

When the shift rod 7 is moved by the swivel arm 31 and thus the movable part 41 (e.g. a piston rod), of the motor 40 in a downward direction from a position as shown in FIG. 2, corresponding to the movement of this rod in the direction of arrow 42 and carried as an open position of flap 19 to permit fluid to flow under pressure to the motor 40 (arrow 43) the lever 5 is forced to pivot about the axle 2 from the position as shown in continuous lines into the position indicated in dash-dot lines in FIG. 2. During this pivoting of the lever 5, the spring 8 is compressed until the pin 6 passes the dead center i.e. the position at which the pin 6 coincides with the center line of the rocker arm 3. After passing the dead center, the tension of the spring 8 will slightly be released, however, the force exerted on the rocker arm 3 to move the latter upwardly increases with the downward movement of the lever 5. The rocker arm 3 is kept in the position as shown in FIGS. 2 and 3 in continuous lines by the lock pawl 14 until the lever 5 strikes against the lug 18 and causes a disengaging of the pawl 14 from the rocker arm 3, as is illustrated in FIG. 4 in dash-dot lines. The rocker arm 3 is thus released and is impelled upwardly until it abuts the stop block 11. The upper position of the rocker arm 3 is shown in dash-dot lines in FIGS. 2 and 3. The upward movement of the rocker arm 3 is transmitted to the actuators 21, 22 so that the flap 19 is closed and flap 20 is opened, or the tubes 24 and 25 are reversed and control the inlet or outlet of the pressure fluid accordingly.

As seen is FIG. 5 this means that fluid now flows from the variable volume chamber 44 of the motor via the flap 20 as shown by the arrow 45 as the piston is returned in the opposite direction.

In order to provide an exact acutation of the flaps 19, 20 or tubes 24, 25, the stop blocks 11, 12 are adjustable to define the movement of the rocker arm 3 between its end positions.

The reversal of the movement of rod 41 causes ultimately a swing of the rocker arm downwardly to again reverse the flow direction and repeat the cycle.

The lever 5 cooperates with the respective lugs 17, 18 in such a manner that the rocker arm 3 is released when the motor reaches one end position or is about to reach this position.

After the flaps or tubes are reversed, the movable part of the motor is caused to move in opposite direction so that the shift rod 7 travels upwardly thus reversing the described steps.

I claim:

1. A device for controlling a motor operated with a pressure medium and having a variable-volume compartment for the pressure medium, said device comprising:

a flow-control unit having a pair of flow-control elements each displaceable between a flow-opening state and a flow-blocking state and connected to said compartment;

means defining a main pivot on said unit;

a cantilever arm having one end swingable about said pivot a rocker arm having one end swingable about said pivot relative to said unit and said cantilever arm;

a telescoping rod pivotally connected at a first pivot at one end to said cantilever arm and at a second pivot at an opposite end to said rocker arm and including:

two telescopingly mutually guided rod parts, and a compression spring surrounding said rod parts and guided thereby while urging said parts apart, whereby said telescoping rod tends to swing said rocker arm by a snap action into extreme positions to opposite sides of said cantilever arm upon displacement of said cantilever arm relative to said rocker arm so that said rod passes through a dead center position in which said first and second pivots are aligned with said main pivot;

respective pawls swingably mounted on said unit and engageable with said rocker arm for respectively retaining said rocker arm in respective ones of said extreme positions until one of said pawls retaining said rocker arm is disengaged therefrom, said pawls each being positioned to be engaged by said cantilever arm to be disengaged from said rocker arm when said cantilever arm is displaced so that said rod passes through said dead center position when said rocker arm is retained by a pawl so that the latter pawl releases the rocker arm and the rocker arm snaps by the force of said spring into its other extreme position and engagement by the other of said pawls;

means on said rocker arm operatively connected with said elements for switching over the said states thereof upon snapping of said rocker arm between said extreme positions; and means for connecting a moving member of said motor with said cantilever arm.

2. The device defined in claim 1 wherein two such pawls are provided and each of said pawls has an abutment adjustably mounted thereon and engageable by said cantilever arm for release of the rocker arm from the respective pawl upon engagement of the cantilever arm upon swinging movement in opposite directions with the respective abutment.

3. The device defined in claim 2 wherein said flow control elements are flaps and each of said flaps has a shaft connected therewith and provided with a formation engageable by a pin on said rocker arm forming the means on said rocker arm operatively connected with said elements.

4. The device defined in claim 2 wherein each of said elements is a tube and said means on said rocker arm operatively connected with said elements is a member for compressing said tube.

* * * * *